US007850436B2

(12) United States Patent
Sawabe et al.

(10) Patent No.: US 7,850,436 B2
(45) Date of Patent: Dec. 14, 2010

(54) FIXING STRUCTURE AND METHOD FOR FIXING UPPER CUP MUFFLER

(75) Inventors: Hiroyuki Sawabe, Ota (JP); Yoshiaki Hiruma, Ota (JP); Hiroyuki Yoshida, Ota (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 523 days.

(21) Appl. No.: 11/389,289

(22) Filed: Mar. 24, 2006

(65) Prior Publication Data

US 2006/0216160 A1 Sep. 28, 2006

(30) Foreign Application Priority Data

Mar. 28, 2005 (JP) ..... 2005-091446

(51) Int. Cl.
*F04B 39/00* (2006.01)
*F04B 53/00* (2006.01)

(52) U.S. Cl. ..... 417/312; 417/902

(58) Field of Classification Search ..... 417/902, 417/312; 418/181, 60; 181/403
See application file for complete search history.

(56) References Cited

U.S. PATENT DOCUMENTS 4,881,879 A * 11/1989 Ortiz ..... 417/312
6,270,329 B1 * 8/2001 Oshima et al. ..... 418/63
6,280,168 B1 * 8/2001 Matsumoto et al. ..... 418/151
6,435,850 B2 * 8/2002 Sunaga et al. ..... 418/63
6,447,274 B1 * 9/2002 Horihata et al. ..... 418/60
6,457,960 B1 * 10/2002 Esumi et al. ..... 418/178
6,582,207 B2 * 6/2003 Matsumoto et al. ..... 417/410.1
6,773,244 B2 * 8/2004 Lee et al. ..... 418/216
6,912,871 B2 * 7/2005 Lee et al. ..... 62/498
2002/0155015 A1 10/2002 Esumi et al.
2006/0153723 A1 * 7/2006 Kurita et al. ..... 418/29

FOREIGN PATENT DOCUMENTS

JP 59176478 A * 10/1984
JP 5-133376 A 5/1993
JP 6-159281 A 6/1994
JP 9-119388 A 5/1997
JP 9119388 A * 5/1997
JP 10-103223 A 4/1998
JP 2005-2832 A 1/2005

* cited by examiner

*Primary Examiner*—Devon C Kramer
*Assistant Examiner*—Amene S Bayou
(74) *Attorney, Agent, or Firm*—Westerman, Hattori, Daniels & Adrian, LLP

(57) ABSTRACT

A structure and method for fixing an upper cup muffler to an upper bearing portion. The upper bearing portion includes a step portion having an upper, lower and side surfaces. A peripheral edge portion between the upper and side surfaces of the upper bearing portion is declined outwardly to have a slant surface. The upper cup muffler includes a bottom surface and a peripheral side surface lower portion that extends downwardly from the edge portion of the bottom surface. The peripheral side surface lower portion gets across the slant surface of the upper bearing portion and is brought into linear or planar contact with at least one of the outer side surface and the lower surface of the step portion when the bottom surface of the upper cup muffler and the upper surface of the upper bearing portion are fixed to each other.

8 Claims, 4 Drawing Sheets

FIXING STRUCTURE AND METHOD FOR FIXING UPPER CUP MUFFLER

BACKGROUND OF THE INVENTION

1. Field of the Invention

The present invention relates to fixing structure and method of fixing an upper cup muffler, and more particularly to fixing structure and method of fixing an upper cup muffler covering a discharge valve provided to an upper bearing portion for sealing the opening of an upper cylinder in a hermetically sealed compressor that is equipped with an electrically-driven element provided at the upper portion of a hermetically sealed container and a rotationally compressing element driven by the rotating shaft of the electrically-driven element and provided at the lower portion of the hermetically sealed container, the electrically-driven element having an oil pool in which oil is stocked at the bottom portion, and the rotationally compressing element having the upper cylinder and a lower cylinder.

2. Description of the Related Art

A hermetically sealed compressor equipped with an electrically-driven element at the upper portion of a hermetically sealed container and a rotationally compressing element at the lower portion of the hermetically sealed container has been disclosed in JP-A-10-103223, for example, and has been broadly known. In this hermetically sealed compressor, the hermetically sealed container has an oil pool in which oil is stocked at the bottom portion, and the rotationally compressing element is driven by the rotating shaft of the electrically-driven element and equipped with an upper cylinder and a lower cylinder.

In the hermetically sealed compressor thus constructed, large noise occurs due to pressure pulsation of refrigerant compressed in the cylinder when it is discharged from the cylinder into the hermetically sealed container. Under such a situation, a cup muffler is used to suppress the noise caused by the pressure pulsation of the compressed refrigerant, a cup muffler has been used. The cut muffler is disclosed in detail in JP-A-05-133376 and JP-A-06-159281, for example.

In order to fix a cup muffler (upper cup muffler) to an upper bearing portion for sealing the opening of the upper cylinder, it is general that the upper cup muffler is pressed and engagedly fitted in the upper bearing portion so that the lower end peripheral side surface of the upper cup muffler is brought into planar contact with the outer side surface of the upper bearing portion.

However, according to the method of fixing the upper cup muffler to the upper bearing portion by pressing and engagedly fitting the upper cup muffler in the upper bearing portion, when a new type of hermetically sealed compressor is developed by changing the shape of the upper bearing portion of the old type of hermetically sealed compressor described above in some degree, the same upper cup muffler as the old type cannot be fixed to the new type, and thus the upper cup muffler for the new type of hermetically sealed compressor must be developed in connection with the change of the upper bearing portion of the new type of hermetically sealed compressor.

SUMMARY OF THE INVENTION

Therefore, an object of the present invention is to provide an upper cup muffler fixing method that is generally usable when an upper cup muffler is fixed to an upper bearing portion for sealing the opening of an upper cylinder.

In order to attain the above object, according to a first aspect of the present invention, in a fixing structure for fixing an upper cup muffler having an upper surface opening and a lower surface opening and covering a discharge valve provided to an upper bearing portion for sealing the opening of an upper cylinder in a hermetically sealed compressor that is equipped with an electrically-driven element provided at the upper portion of a hermetically sealed container and a rotationally compressing element driven by a rotating shaft of the electrically-driven element and provided at the lower portion of the hermetically sealed container, the upper bearing portion includes a step portion having an upper surface, a lower surface and a side surface between the upper and lower surfaces, the peripheral edge portion between the upper and side surfaces of the upper bearing portion is declined outwardly to have a slant surface, and the upper cup muffler includes a bottom surface and a peripheral side surface lower portion that extends downwardly from the edge portion of the bottom surface of the upper cup muffler and forms the lower surface opening, and the peripheral side surface lower portion gets across the slant surface of the upper bearing portion and is brought into linear or planar contact with at least one of the outer side surface and the lower surface of the step portion when the bottom surface of the upper cup muffler and the upper surface of the upper bearing portion are fixed to each other by fastening a bolt, thereby sealing the upper bearing portion.

In the above-described fixing structure, the peripheral side surface lower portion of the upper cup muffler is provided with a flange portion extending outwardly from the edge of the peripheral side surface lower portion, and the flange portion is brought into contact with the lower surface of the step portion of the upper bearing portion when the upper cup muffler and the upper bearing portion are fixed to each other, thereby sealing the upper bearing portion more surely.

In the above-described fixing structure, the outer side surface of the step portion is designed to have a vertical plane.

In the above-described fixing structure, the outer side surface of the step portion is designed as a slant surface whose gradient angle is equal to that of the slant surface at the peripheral edge portion between the upper and side surfaces of the upper bearing portion.

According to a second aspect of the present invention, a fixing method for fixing an upper cup muffler having an upper surface opening and a lower surface opening and covering a discharge valve provided to an upper bearing portion for sealing the opening of an upper cylinder in a hermetically sealed compressor that is equipped with an electrically-driven element provided at the upper portion of a hermetically sealed container and a rotationally compressing element driven by a rotating shaft of the electrically-driven element and provided at the lower portion of the hermetically sealed container, the upper cup muffler including a bottom surface and a peripheral side surface lower portion that extends downwardly from the edge portion of the bottom surface of the upper cup muffler and forms the lower surface opening, and the upper bearing portion including a step portion having an upper surface, a lower surface and a side surface between the upper and lower surfaces, comprises steps of: bringing the peripheral side surface lower portion of the upper cup muffler into contact with a slant surface that is formed between the upper surface and the side surface of the step portion of the upper bearing portion so as to be gradually declined outwardly; and fixing the upper cup muffler to the upper bearing portion by fastening a bolt screwed in the upper cup muffler and the upper bearing portion so that the peripheral side surface lower portion gets across the slant surface and is brought into linear or planar contact with at least one of the outer side surface of the upper bearing portion, thereby sealing the upper bearing portion.

In the above-described fixing method, the peripheral side surface lower portion of the upper cup muffler is equipped with a flange portion extending outwardly at the edge thereof, and the flange portion is brought into contact with the lower surface of the step portion of the upper bearing portion, thereby sealing the upper bearing portion surely.

According to the present invention, when the upper cup muffler is fixed to the upper bearing portion for sealing the opening of the upper cylinder, a structure and a method of fixing a general-purpose type upper cup muffler can be provided. Even when the shape of the upper bearing portion is changed in some degree, the same upper cup muffler can be used to achieve the sealing performance at the same level.

DETAILED DESCRIPTION OF THE PREFERRED EMBODIMENTS

Figure 1:
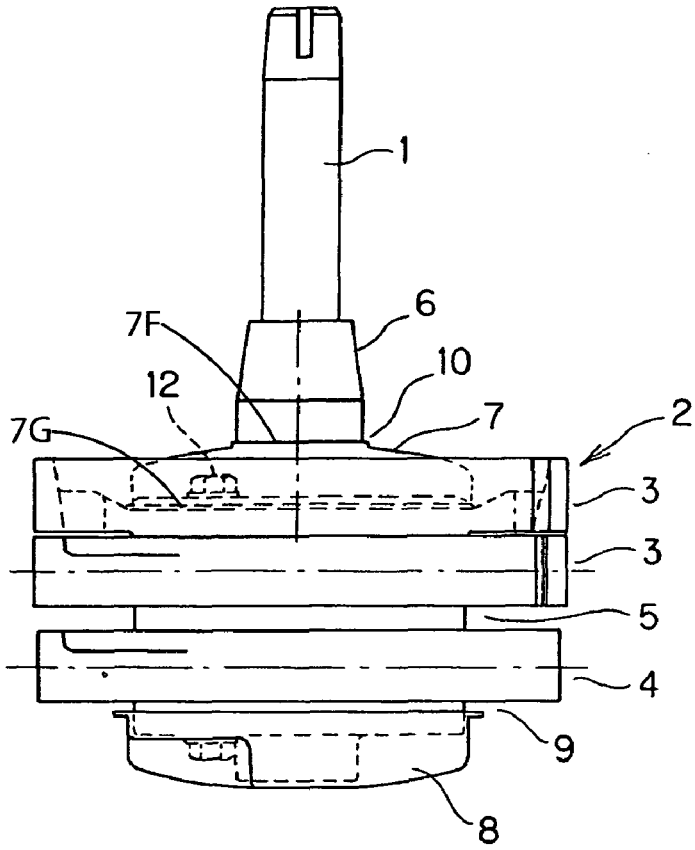
FIG. 1 is a front view showing a rotationally compressing element provided in a hermetically sealed container.

Preferred embodiments according to the present invention will be described hereunder with reference to the accompanying drawings.

An embodiment of the present invention will be described hereunder with reference to FIGS. 1 to 4.

An electrically-driven element (not shown) is provided at the upper portion of the inside of a hermetically sealed container (not shown) having an oil pool in which oil is stocked at the bottom portion, and a rotationally compressing element 2 driven by a rotating shaft 1 of the electrically-driven element is provided at the lower portion of the inside of the hermetically sealed container. The electrically-driven element comprises a stator fixed to the inner wall of the hermetically sealed container, and a rotor whose rotating shaft 1 is inserted in the stator so as to face the inner surface of the stator through air gap.

The rotationally compressing element 2 is equipped with two upper cylinders 3 and a lower cylinder 4. The upper cylinders 3 are fixed in the hermetically sealed container by welding, and the lower cylinder 4 is fixed to the upper cylinder 3 through an intermediate partition plate 5.

The rotationally compressing element 2 is further equipped with an upper roller (not shown) rotated in each upper cylinder 3 by an upper eccentric portion of the rotating shaft 1, an upper vane (not shown) that is brought into contact with the upper roller to divide the inside of the upper cylinder 3, an upper bearing portion 6 for sealing the opening of the upper cylinder 3, an upper discharge port (not shown) having an upper discharge valve provided to the upper bearing portion 6, and an upper cup muffler 7 covering the upper discharge valve. Furthermore, the rotationally compressing element 2 is further equipped with a lower roller (not shown) rotated in the lower cylinder 4 by a lower eccentric portion of the rotating shaft 1, a lower vane (not shown) that is brought into contact with the lower roller to divide the inside of the lower cylinder 4, a lower bearing portion 9 for sealing the opening of the lower cylinder 4, a lower discharge port (not shown) having a lower discharge valve provided to the lower bearing portion 9, and a lower cup muffler 8 covering the lower discharge valve provided to the lower bearing portion 9.

A refrigerant discharge pipe is provided to an end cap constituting the upper cap of the hermetically sealed container so as to penetrate through the end cap.

In the hermetically sealed rotary compressor thus constructed, refrigerant passing through an accumulator and flowing from an upper suction port into the upper cylinder 3 is compressed in cooperation of the upper roller and the upper vane, and discharged into the upper cup muffler 7 by opening the discharge valve of the upper discharge port. The refrigerant in the upper cup muffler 7 passes from the discharge port 10 through the air gap of the electrically-driven element and discharged to the upper portion of the electrically-driven element.

Furthermore, the refrigerant passing through the accumulator and flowing from the upper suction port into the lower cylinder 4 is likewise compressed in cooperation of the lower roller and the lower vane, and discharged into the lower cup muffler 8 by opening the lower discharge valve of the lower discharge port. The refrigerant in the lower cup muffler 8 is passed through passages inside and outside the hermetically sealed container, introduced into the lower portion of the electrically-driven element, passed through the air gap and then discharged to the upper portion of the electrically-driven element. The refrigerant discharged to the upper portion of the electrically-driven element is turned by the rotation of the rotor. Therefore, oil which is contained in the refrigerant and heavier in mass than the refrigerant is flung away to the inner wall side of the hermetically sealed container by centrifugal force, so that the oil can be separated from the refrigerant. The refrigerant from which the oil has been separated is discharged from the discharge pipe to the outside of the hermetically sealed container. The oil thus separated is returned from an oil return hole to the oil pool.

Here, a method of fixing the upper cup muffler 7 formed of a steel plate such as SPCC, SPH or the like to the upper bearing portion 6 described above will be described with reference to FIGS. 2 to 4. When the upper cup muffler 7 is fixed to the upper bearing portion 6, the upper and lower surfaces of the upper cup muffler 7 are first opened, the narrow (small diameter) portion of the upper bearing portion 6 is inserted in an upper surface opening 7F of the upper cup muffler 7, and a peripheral side surface lower portion 7D forming a lower surface opening 7G of the upper cup muffler 7 is brought into contact with a slant surface 6A which is formed at the upper surface peripheral edge portion of a wide (large-diameter) portion of the upper bearing portion 6 so as to be gradually declined outwardly as shown in FIG. 2.

Figure 2:
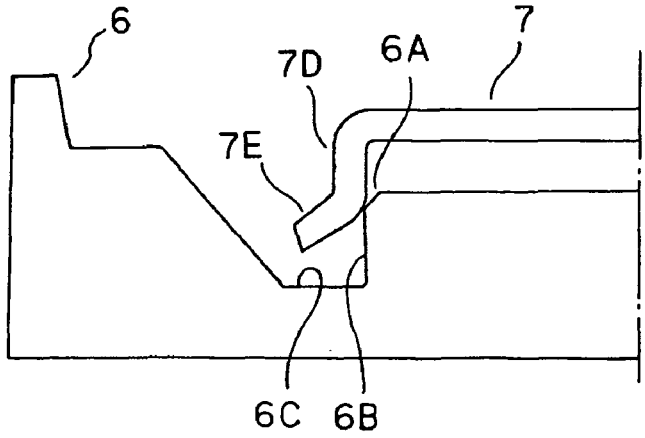
FIG. 2 is a partially cross-sectional view showing a state where the lower portion of the peripheral side surface of an upper cup muffler is brought into contact with a slant surface formed at the peripheral edge portion of the upper surface of an upper bearing portion.

Furthermore, the peripheral side surface lower portion 7D forming the opening of the lower surface of the upper cup muffler 7 is equipped with a flange E that spreads out obliquely outwardly (i.e., extends in an obliquely outward and downward direction in cross-sectional view of FIG. 2). With respect to the upper bearing portion 6, the slant surface 6A is formed at the peripheral edge portion of the upper surface of the large-diameter portion of the upper bearing 6 so as to be gradually declined to the outside (i.e., extends in an obliquely outward and downward direction in cross-sectional view of FIG. 2 like the flange E), and also a lower upper surface 6C is formed at a lower position than the upper surface of the large-diameter portion of the upper bearing portion 6 so that a step is formed between the upper surface of the large-diameter portion and the lower upper surface 6C.

Figure 3:
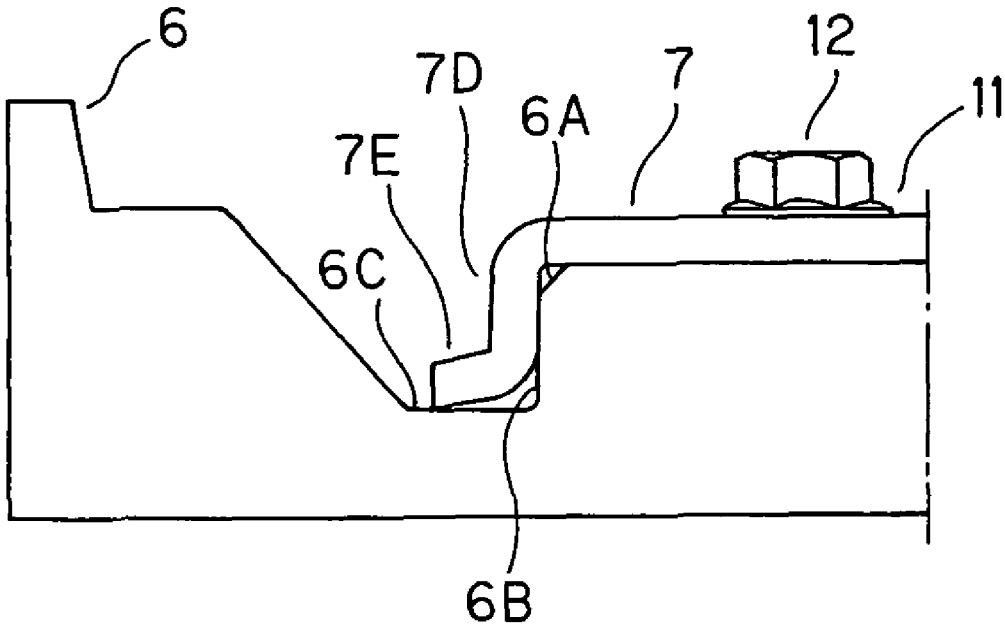
FIG. 3 is a partially cross-sectional view showing a state where the upper cup muffler is fixed to the upper bearing portion.
Figure 4:
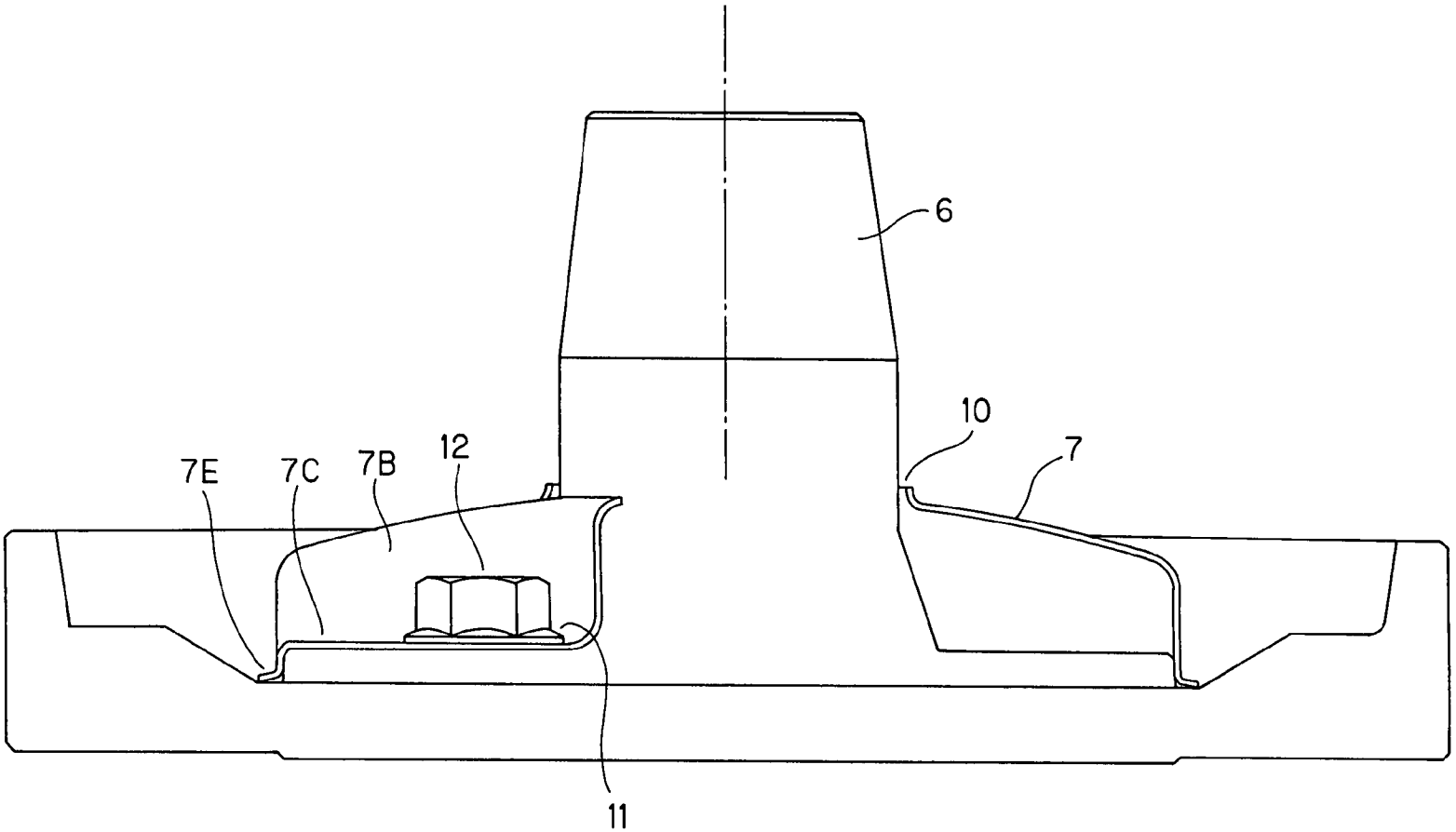
FIG. 4 is a partially broken diagram showing a state where the upper cup muffler is fixed to the upper bearing portion.

Accordingly, the peripheral side surface lower portion 7D of the upper cup muffler 7 first abuts against (is brought into contact with) the slant surface 6A formed at the peripheral edge portion of the upper surface of the large-diameter portion of the upper bearing portion 6. Thereafter, a washer-integral-type bolt having a thread groove is engagedly fitted in screw holes formed in the bottom surface 7C forming a fixing recess portion 7B of the upper cup muffler 7 and the upper surface of the upper bearing portion 6 by screwing the bolt into the screw holes. At this time, by fastening the bolt 12, the peripheral side surface lower portion 7D of the upper cup muffler 7 gets across the slant surface 6A and fitted to the outer side surface 6B so as to be brought into planar contact with the outer side surface 6B as shown in FIGS. 3 and 4. Furthermore, the tip of the flange 7E is brought into linear contact with the lower upper surface 6C, and slightly deformed outwardly to spread out. Therefore, the sealing can be performed dually (through the planar contact and the linear contact between the cup muffler 7 and the upper bearing portion 6).

Accordingly, even when the shape of the upper bearing portion 6 is changed in some degree, the upper cup muffler 7 can be surely fixed to the upper bearing portion 6 to surely seal the upper bearing portion 6. Accordingly, the refrigerant can be surely prevented from leaking from the fixing portion between the upper cup muffler 7 and the upper bearing portion 6.

Next, the method of fixing a modification of the upper cup muffler 7 constructed by the steel plate of SPCC, SPH or the like to the upper bearing portion 6 will be described with reference to FIGS. 5 and 6.

Figure 5:
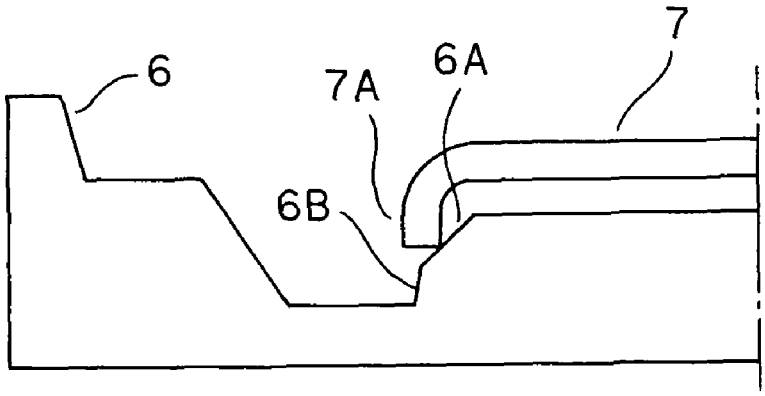
FIG. 5 is a partially cross-sectional view showing a state where the lower portion of the peripheral side surface of a modification of the upper cup muffler is brought into contact with a slant surface formed at the peripheral edge portion of the upper surface of the upper bearing portion.
Figure 6:
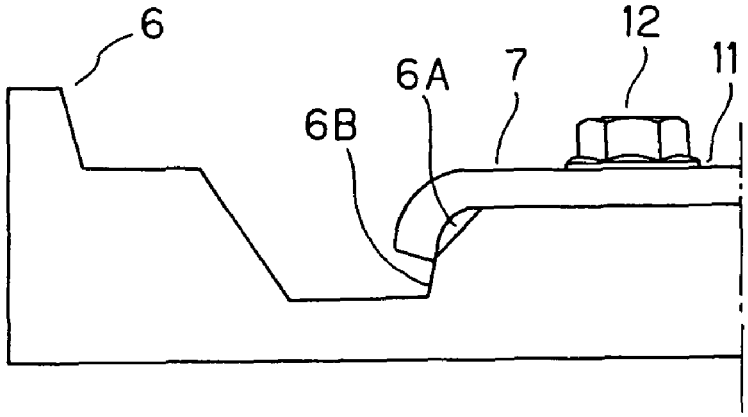
FIG. 6 is a partially cross-sectional view showing a state where the modification of the upper cup muffler is fixed to the upper bearing portion.

When the upper cup muffler 7 is fixed to the upper bearing portion 6 as shown in FIG. 5, the upper cup muffler 7 is first opened at the upper and lower surfaces thereof, a narrow (small-diameter) portion of the upper bearing portion 6 is inserted into the opening of the upper surface, and the peripheral side surface lower end portion 7A forming the opening of the lower surface of the upper cup muffler 7 is brought into contact with a slant surface 6A which is formed at the peripheral edge portion of the upper surface of the large-diameter portion of the upper bearing portion 6 so as to be gradually lowered in the outward direction (i.e., gradually declined outwardly).

Subsequently, a washer-integral-type bolt 12 having a thread groove is engagedly fitted in screw holes formed in the bottom surface 7C forming a fixing recess portion 7B of the upper cup muffler 7 and the upper surface of the upper bearing portion 6 by screwing the bolt into the screw holes. At this time, by fastening the bolt 12 as shown in FIG. 6, the lower end portion 7A of the peripheral side surface of the upper cup muffler 7 gets across the slant surface 6A and fitted to the outer side surface 6B so as to be brought into linear contact with the outer side surface 6B as shown in FIG. 6.

Accordingly, the upper cup muffler 7 can be fixed to the upper bearing portion 6 to surely seal the upper bearing portion 6 even when the upper cup muffler 7 or the upper bearing portion 6 is changed in some degree. Accordingly, the refrigerant can be prevented from leaking from the fixing portion between the upper cup muffler 7 and the bearing portion 6.

In the first and second embodiments, the outer side surface 6B may be a vertical surface (vertical plane) or a slant surface which is inclined at a predetermined angle with respect to the vertical direction. Even when the outer side surface is a slant surface, the gradient angle of the outer side surface is set to be equal to that of the slant surface 6A, that is, the outer side surface may be set to an extension surface of the slant surface 6A.

Various alternatives, corrections and modifications may be made to the above-described embodiments on the basis of the foregoing description by persons skilled in the art, and the present invention may contain various alternatives, corrections and modifications without departing from the subject matter of the present invention.

What is claimed is:

1. A fixing structure for fixing an upper cup muffler having an upper surface opening and a lower surface opening and the upper cup muffler covering a discharge port provided to an upper bearing portion for sealing an opening of an upper cylinder in a hermetically sealed compressor that includes a rotationally compressing element, wherein the upper bearing portion includes a step portion having an upper surface, a lower surface, a side surface between the upper and lower surfaces, and a peripheral edge portion between the upper and side surfaces of the upper bearing portion declined outwardly to have a slant surface, and the upper cup muffler includes a top and a bottom surface and a peripheral side surface lower portion that extends downwardly from an outer peripheral edge portion of the top and bottom surface of the upper cup muffler and forms the lower surface opening, and bolt means extending through the bottom surface of the upper cup muffler for exerting downward force on said upper cup muffler, the peripheral side surface lower portion being sized and positioned to engage said slant surface and flex outwardly as said downward force is applied to sealingly engage at least one of the side surface and the lower surface of the step portion when the bottom surface of the upper cup muffler and the upper surface of the upper bearing portion are fixed to each other by said bolt means, thereby sealing the upper bearing portion;

wherein the side surface of the step portion of the upper bearing portion has a slant surface having a different slant angle from the slant surface of the peripheral edge portion and the bolt means exerts downward force on the upper cup muffler so as to make the peripheral side surface lower portion of the upper cup muffler come into contact with the slant surface of the peripheral edge portion of the step portion of the upper bearing portion, slide along the slant surface of the peripheral edge portion, get across the boundary between the slant surface of the peripheral edge portion and the slant surface of the side surface and then engage the slant surface of the side surface, thereby fixing the upper cup muffler and the upper bearing portion to each other; and said two slant surfaces constitute an outwardly bent slant surface.

2. The fixing structure according to claim 1, wherein the peripheral side surface lower portion of the upper cup muffler is provided with a flange portion extending outwardly from the edge of the peripheral side surface lower portion, and the flange portion is brought into contact with the lower surface of the step portion of the upper bearing portion when the upper cup muffler and the upper bearing portion are fixed to each other, thereby sealing the upper bearing portion more surely.

3. The fixing structure according to claim 1, wherein the side surface of the step portion is designed to have a vertical plane.

4. The fixing structure according to claim 1, wherein the side surface of the step portion is designed as a slant surface whose gradient angle is equal to that of the slant surface at the peripheral edge portion between the upper and side surfaces of the upper bearing portion.

5. A fixing method for fixing an upper cup muffler having an upper surface opening and a lower surface opening for use in a hermetically sealed compressor of the type having a discharge port and a rotationally compressing element, the upper cup muffler including a bottom surface and a peripheral side surface lower portion that extends downwardly from an outer peripheral edge portion of the bottom surface of the upper cup muffler and forms the lower surface opening, an opening in said bottom surface for receiving a bolt there through and engaging said bottom surface to exert a downward force on said bottom surface and an upper bearing portion including a step portion having an upper surface, a lower surface and a side surface between the upper and lower surfaces, comprising the steps of:

bringing the peripheral side surface lower portion at the outer peripheral edge portion of the upper cup muffler into contact with a first slant surface that is formed between the upper surface and the side surface of the step portion of the upper bearing portion so as to be gradually declined outwardly;

fixing the bottom surface of the upper cup muffler and the upper surface of the upper bearing portion with a bolt means, wherein the side surface of the step portion of the upper bearing portion has a second slant surface with a different slant angle from the first slant surface, by exerting, by the bolt means, a downward force on the upper cup muffler so as to make the peripheral side surface lower portion of the upper cup muffler come into contact with the first slant surface of the step portion of the upper bearing portion, slide along the first slant surface and get across the boundary between the first slant surface and the second slant surface and engage the second slant surface by flexing outwardly, thereby fixing the upper cup muffler and the upper bearing portion to each other and sealing the upper bearing portion;

wherein the first and second slant surfaces constitute an outwardly bent slant surface.

6. The fixing method according to claim 5, wherein the peripheral side surface lower portion of the upper cup muffler is equipped with a flange portion extending outwardly at the edge thereof, and the flange portion is brought into contact with the lower surface of the step portion of the upper bearing portion, thereby sealing the upper bearing portion surely.

7. The fixing structure according to claim 1, wherein the two slant surfaces are configures so that the slant angle of one of the two slant surfaces is sharper than a slant angle of the other of the two slant surfaces.

8. The method according to claim 5, wherein the first and second slant surfaces are configured so that the slant angle of one of the two slant surfaces is sharper than a slant angle of the other of the two slant surfaces.

* * * * *